US008353080B2

(12) United States Patent
Huang

(10) Patent No.: US 8,353,080 B2
(45) Date of Patent: Jan. 15, 2013

(54) UMBRELLA HANDLE

(76) Inventor: Lu Tsai Huang, Changhua (TW)

( * ) Notice: Subject to any disclaimer, the term of this patent is extended or adjusted under 35 U.S.C. 154(b) by 558 days.

(21) Appl. No.: 12/592,520

(22) Filed: Nov. 27, 2009

(65) Prior Publication Data

US 2011/0126379 A1 Jun. 2, 2011

(51) Int. Cl.
*A47B 95/02* (2006.01)

(52) U.S. Cl. ..... 16/110.1; 16/423; 16/903; 16/906; 16/DIG. 15

(58) Field of Classification Search ..... 16/110.1, 16/111.1, 423, 903, 906, DIG. 15; 135/16, 135/24; 361/232; 362/102, 157; 455/344
See application file for complete search history.

(56) References Cited

U.S. PATENT DOCUMENTS 4,093,969 A 6/1978 Maynor, Jr.
5,029,239 A 7/1991 Nesbit
5,323,798 A 6/1994 Yang
5,564,449 A 10/1996 Lin et al.
5,707,135 A * 1/1998 Miller, Jr. ..... 362/102
D410,328 S * 6/1999 Alajajian et al. ..... D3/13
D430,726 S * 9/2000 Burbrink ..... D3/13
6,283,610 B1 * 9/2001 Alajajian ..... 362/199

* cited by examiner

*Primary Examiner* — Roberta Delisle
(74) *Attorney, Agent, or Firm* — Charles E. Baxley

(57) ABSTRACT

An umbrella handle includes a tubular member having an inclined bottom wall, and a housing having an axle extended from an inclined upper wall for rotatably engaging with the inclined bottom wall of the tubular member and for allowing the housing to be rotated relative to the tubular member to different directions and for allowing the housing to be folded and inclined relative to the tubular member to different folding statuses, a flashlight device is attached to the housing for facing or directing toward various or different directions and for lighting the environment when the housing is pivoted or rotated relative to the tubular member to different or various directions.

10 Claims, 7 Drawing Sheets

UMBRELLA HANDLE

BACKGROUND OF THE INVENTION

1. Field of the Invention

The present invention relates to an umbrella handle, and more particularly to an umbrella handle including a foldable structure for allowing the umbrella handle to be folded to various inclined or tilted configuration and for allowing the umbrella handle to be easily grasped or held by the user, and including a flashlight device for generating a light toward various direction.

2. Description of the Prior Art

Typical umbrella handles comprise an umbrella handle provided or disposed on the lower portion of the handle member for being grasped or held by the user, and normally, the handle member includes a straight or longitudinal structure for being easily grasped or held by the user.

For example, U.S. Pat. No. 4,093,969 to Maynor, Jr. discloses one of the typical umbrella devices comprising a folded or U-shaped handle member for being grasped or held by the user, and a high powered electric shocking device disposed or attached to the handle member.

However, the handle member of the typical umbrella device comprises a predetermined structure or shape which may not be folded or directed toward various directions such that the handle member may not be comfortably grasped or held by the user. In addition, no flashlight devices have been provided for generating the light to light the environment.

U.S. Pat. No. 5,029,239 to Nesbit discloses another typical umbrella device equipped with a radio and comprising a hollow interior shaft with a canopy attached at the top portion of the shaft, and an audio signal source attached to the shaft of the typical umbrella device.

However, the shaft of the typical umbrella device also comprises a predetermined and longitudinal structure or shape which may not be folded or directed toward various directions such that the handle member may not be comfortably grasped or held by the user. In addition, no flashlight devices have been provided for generating the light to light the environment.

U.S. Pat. No. 5,323,798 to Yang discloses a further typical umbrella device comprising a hollow tubular handle equipped with a flashlight device for generating the light to light the environment on rainy or dark days.

However, the hollow tubular handle of the typical umbrella device comprises a predetermined and longitudinal structure or shape which may not be folded or directed toward various directions such that the handle member may not be comfortably grasped or held by the user. In addition, the flashlight device includes a number of light members that are required to be attached to the tips of the canopy, but the light members may not be easily attached to the tips of the canopy and may greatly increase the manufacturing cost for the typical umbrella device.

U.S. Pat. No. 5,564,449 to Lin et al. discloses a still further typical umbrella device comprising a grip provided or disposed on the lower portion of the handle member for being grasped or held by the user.

However, the handle member of the typical umbrella device also comprises a predetermined and longitudinal structure or shape which may not be folded or directed toward various directions such that the handle member may not be comfortably grasped or held by the user. In addition, no flashlight devices have been provided for generating the light to light the environment.

The present invention has arisen to mitigate and/or obviate the afore-described disadvantages of the conventional umbrella handle members.

SUMMARY OF THE INVENTION

The primary objective of the present invention is to provide an umbrella handle including a foldable structure for allowing the umbrella handle to be folded to various inclined or tilted configuration and for allowing the umbrella handle to be easily grasped or held by the user.

The other objective of the present invention is to provide an umbrella handle including a flashlight device attached to the umbrella handle and adjustable to various direction for generating the light toward various direction.

In accordance with one aspect of the invention, there is provided an umbrella handle comprising a tubular member including a longitudinal axis, and including an inclined bottom wall tilted relative to the longitudinal axis of the tubular member, and a housing including a longitudinal axis, and including an inclined upper wall tilted relative to the longitudinal axis of the housing, and including an axle for rotatably engaging with the inclined bottom wall of the tubular member and for allowing the housing to be rotated relative to the tubular member to different directions and for allowing the housing to be folded and inclined relative to the tubular member to different folding statuses and for allowing the umbrella handle to be easily and suitably or comfortably grasped or held by the user.

The axle is extended from the inclined upper wall of the housing, and the tubular member includes a coupling member engaged with the axle for rotatably coupling the housing to the tubular member and thus for stably retaining the housing to the tubular member.

The coupling member includes an inner thread formed therein for threading and engaging with the axle and for securing the housing to the tubular member, and the coupling member includes a non-circular engaging hole formed therein for engaging with a driving tool and for allowing the coupling member to be rotated or driven relative to the tubular member and the axle of the housing by the driving tool.

The coupling member includes an outer peripheral flange extended radially and outwardly therefrom for engaging with the tubular member and for stably anchoring or securing the housing to the tubular member.

The housing includes a number of depressions formed in the upper wall, and a spring-biased projection engaged into the tubular member and partially extendible out of the tubular member for selectively engaging with either of the depressions of the upper wall and for anchoring the housing to the tubular member at a required angular direction.

The housing includes a key or projection or guide extended from the upper wall, and the tubular member includes a curved channel formed in the bottom wall for slidably receiving and engaging with the guide and for limiting the housing to rotate relative to the tubular member.

The housing includes a flashlight device for generating a light, and the flashlight device includes at least one battery, a reflector, at least one light member attached to a circuit board and engaged into the reflector and coupled to the battery for generating the light to light the environment.

The flashlight device includes a casing engaged into the housing and having a space formed therein for receiving the battery, and a switch slidably attached to the casing for controlling the battery to selectively energize the light member. The housing includes a slidable switch button aligned with the switch for being depressed by the user to engage with the switch and to operate the light member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
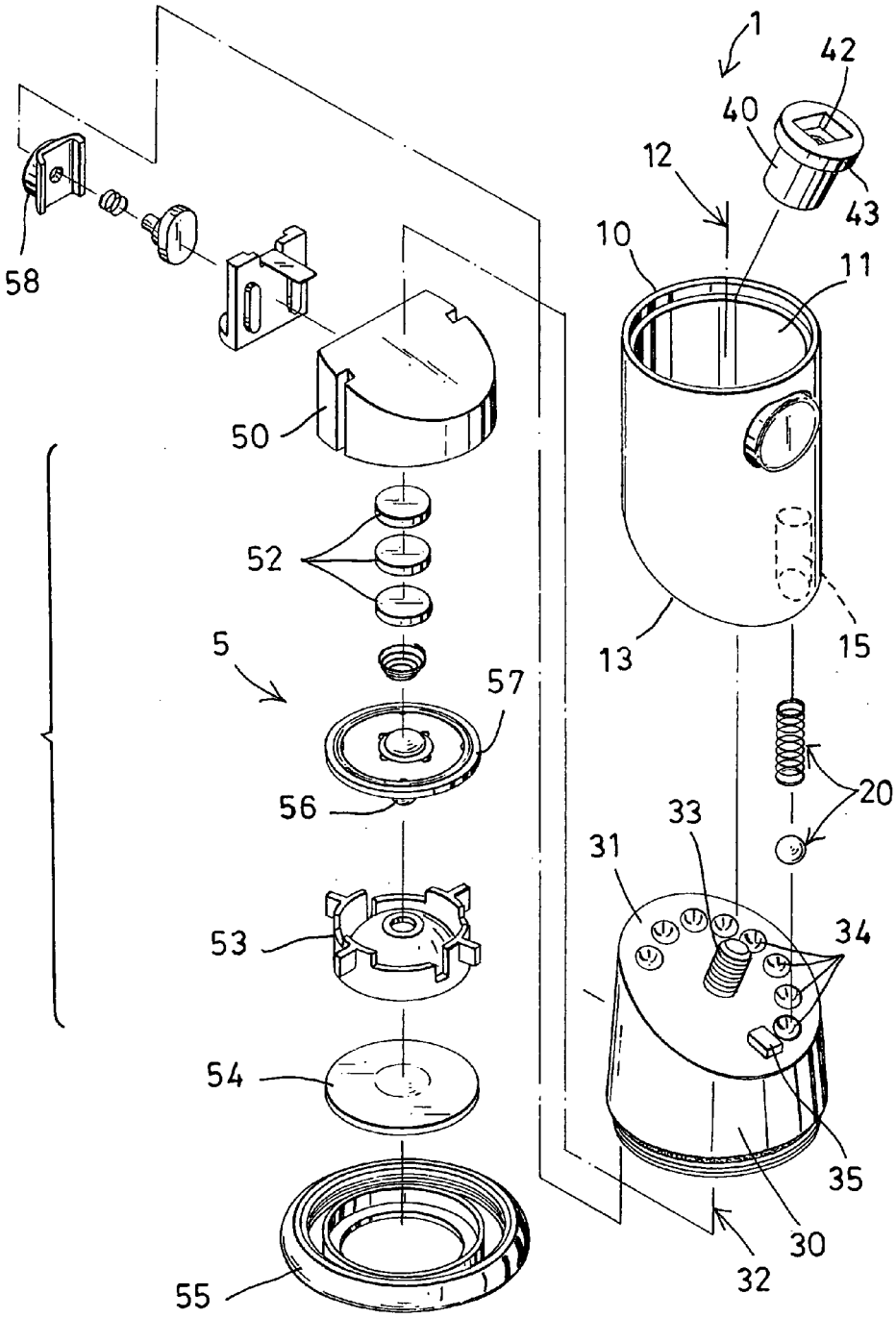
FIG. 1 is an exploded view of an umbrella handle in accordance with the present invention.

Referring to the drawings, and initially to FIGS. 1-5, an umbrella handle 1 in accordance with the present invention comprises a tubular member 10 including a chamber 11 formed therein for coupling to a central telescopic stick of the typical umbrella devices (not shown), and including a longitudinal direction or axis 12, and including an inclined bottom wall 13 tilted or inclined relative to the longitudinal direction or axis 12 of the tubular member 10, and including a bore 14 formed in the center portion of the bottom wall 13 and communicative with the chamber 11 of the tubular member 10, and including a cavity 15 formed in the outer peripheral portion of the bottom wall 13 and offset or separated from the bore 14 of the tubular member 10.

For example, the umbrella handle 1 includes a spring-biased projection 20 disposed or engaged into the cavity 15 of the tubular member 10 and partially extendible out of the cavity 15 of the tubular member 10, and further includes a curved channel 16 formed in the outer peripheral portion of the bottom wall 13 and offset or separated from the cavity 15 of the tubular member 10. It is preferable that the curved channel 16 is located beside the cavity 15 of the tubular member 10 and includes an extending range of about 180 degrees. The umbrella handle 1 further includes a carrier or cartridge or housing 30 for pivotally or rotatably attaching or coupling to the tubular member 10.

The housing 30 includes an inclined upper wall 31 tilted or inclined relative to the longitudinal direction or axis 32 of the housing 30 (FIG. 4) for pivotally or rotatably engaging with the inclined bottom wall 13 of the tubular member 10 and for allowing the housing 30 to be pivoted or rotated relative to the tubular member 10 to different or various directions and for allowing the housing 30 to be folded or tilted or inclined relative to the tubular member 10 to different or various folding statuses (FIGS. 2, 6), and includes a fastener or axle 33 extended upwardly and outwardly from the inclined upper wall 31 of the housing 30 and perpendicular to the inclined upper wall 31 of the housing 30 for pivotally or rotatably engaging into the bore 14 of the tubular member 10 (FIGS. 3, 4) and for pivotally or rotatably attaching or coupling the housing 30 to the tubular member 10.

Another fastener or lock nut or coupling member 40 includes an inner thread 41 formed therein (FIGS. 3, 4) for threading or engaging with the fastener or axle 33 and for stably and pivotally or rotatably attaching or coupling the housing 30 to the tubular member 10, and includes a square or non-circular engaging hole 42 formed in the outer or free end portion thereof for engaging with a driving tool (not shown) and for allowing the coupling member 40 to be rotated or driven relative to the tubular member 10 and the axle 33 of the housing 30 and for solidly securing or mounting the housing 30 to the tubular member 10, and includes an outer peripheral flange 43 extended radially and outwardly from the outer peripheral portion of the coupling member 40 for engaging with the tubular member 10 and for solidly securing or mounting the housing 30 to the tubular member 10.

Figure 7:
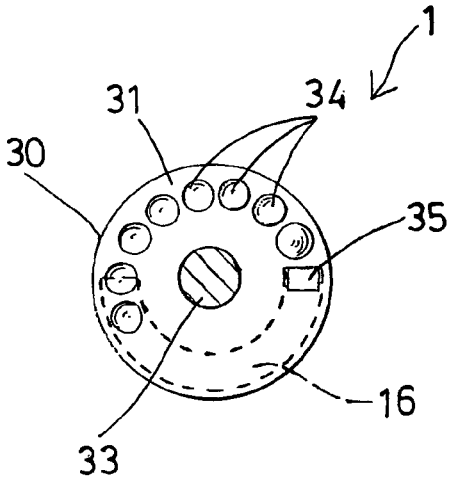
FIGS. 7, 8 are top plan schematic views illustrating the operation of the umbrella handle.
Figure 8:
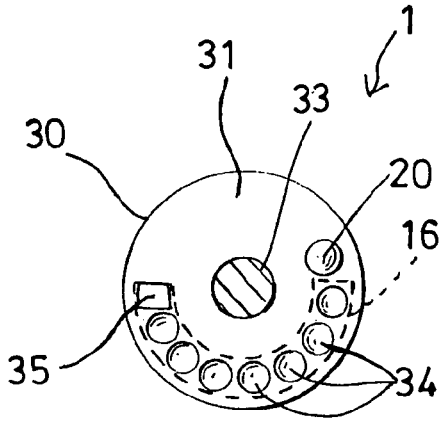

In operation, as shown in FIGS. 2-4 and 6-8, the housing 30 may be pivoted or rotated relative to the tubular member 10 to different or various directions with the axle 33 and/or the coupling member 40 and for allowing the umbrella handle 1 to be easily and suitably or firmly grasped or held by the user. The housing 30 may further include a number of depressions 34 formed in the outer peripheral portion of the upper wall 31 of the housing 30 for selectively engaging with the spring-biased projection 20 and for anchoring or positioning or retaining the housing 30 to the tubular member 10 at the required or predetermined angular directions, and may further include a key or projection or guide 35 extended from the upper wall 31 of the housing 30 for slidably engaging with the curved channel 16 of the tubular member 10 and for limiting the housing 30 to pivot or rotate relative to the tubular member 10 (FIGS. 7, 8).

Figure 3:
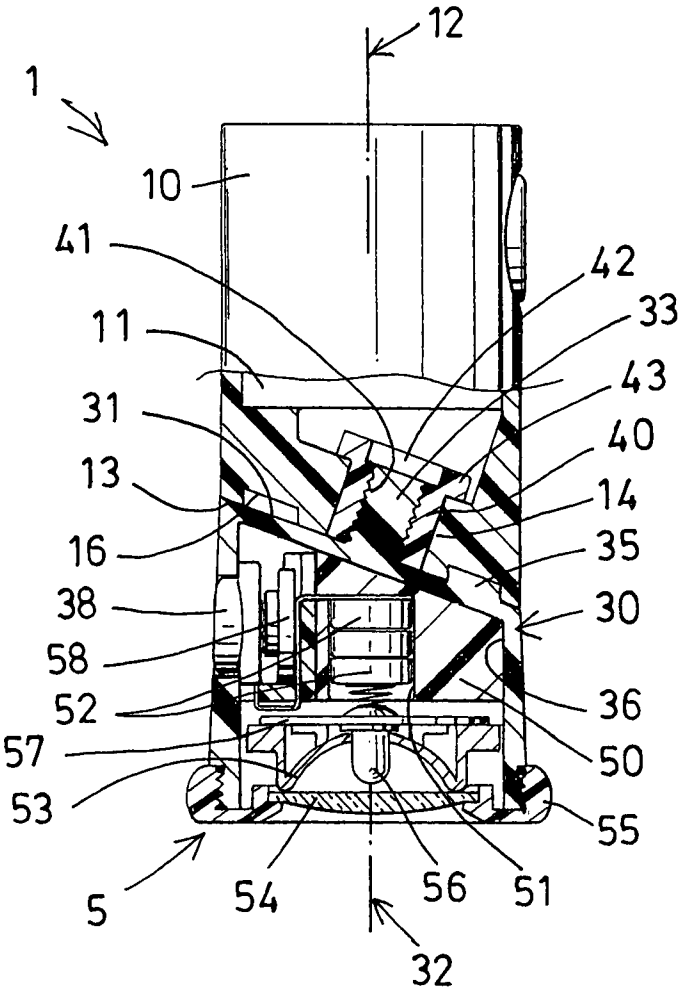
FIG. 3 is another side plan schematic view of the umbrella handle in which a portion of the umbrella handle has been cut off for showing the inner structure of the umbrella handle.
Figure 5:
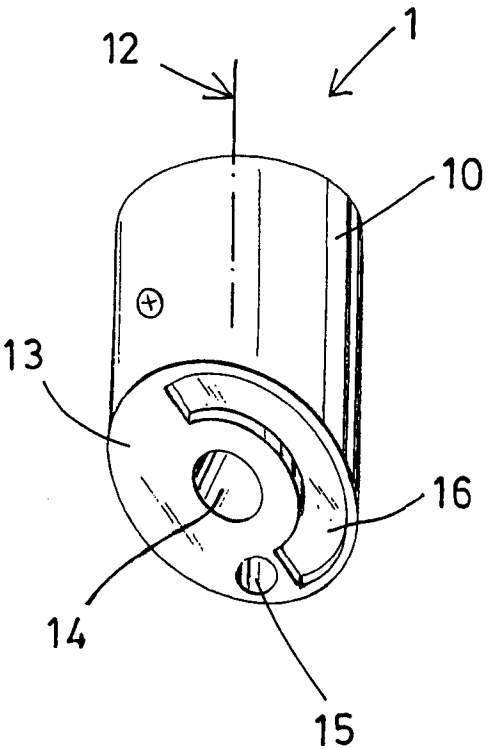
FIG. 5 is a perspective view illustrating a tubular member of the umbrella handle.
Figure 4:
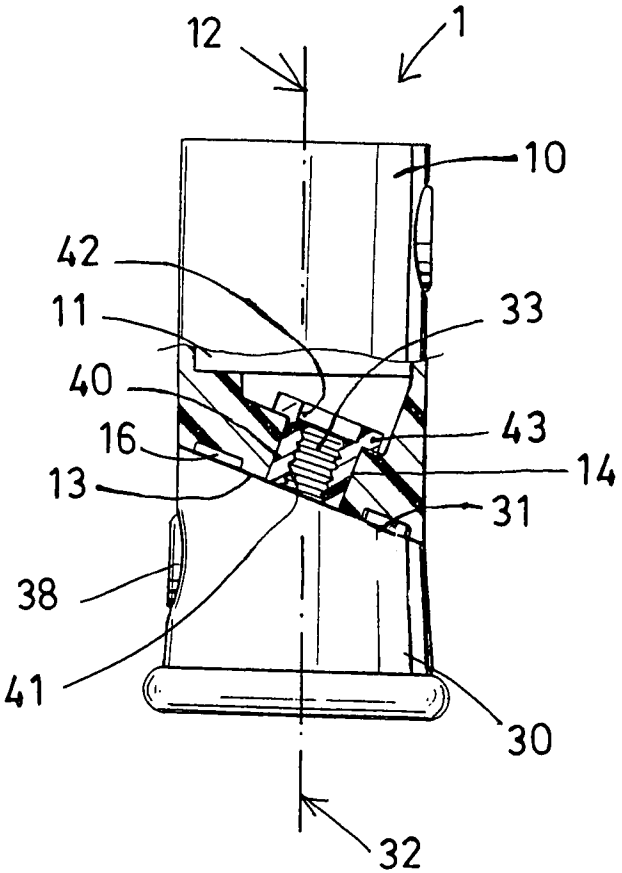
FIG. 4 is a further side plan schematic view of the umbrella handle in which a portion of the umbrella handle has been cut off for showing the inner structure of the umbrella handle.

The housing 30 includes a compartment 36 formed therein (FIG. 3) for receiving a flashlight device 5 (FIGS. 1, 3). For example, the flashlight device 5 includes a casing 50 engaged into the compartment 36 of the housing 30 and having a space 51 formed therein for receiving or engaging with one or more cells or batteries 52, a reflector 53 and a lens or hood 54 attached or mounted to the bottom or lower end portion of the housing 30 with a lock nut or ferrule 55, and one or more light bulbs or light members 56 attached to a circuit board 57 and engaged into the reflector 53 and electrically coupled to the cells or batteries 52 for generating the light, and a switch 58 slidably attached or engaged with the casing 50 for switching or controlling the batteries 52 to selectively energize the light members 56 and to selectively generate the light to light the environment.

Figure 2:
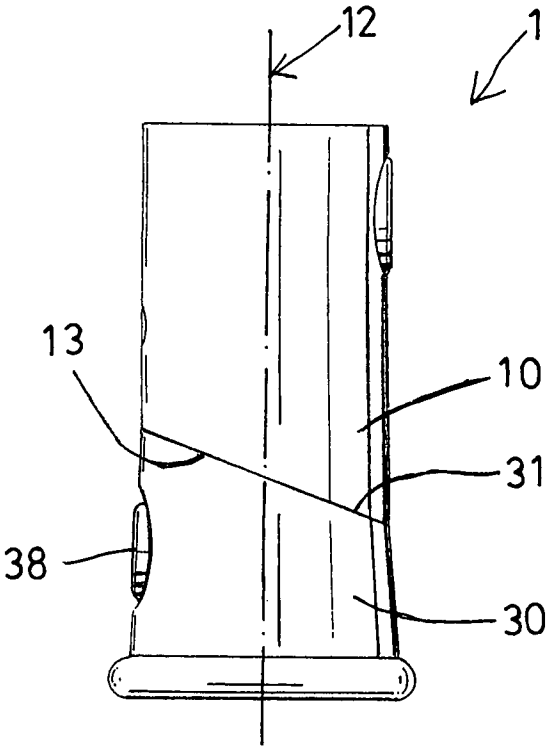
FIG. 2 is a side plan schematic view of the umbrella handle.
Figure 6:
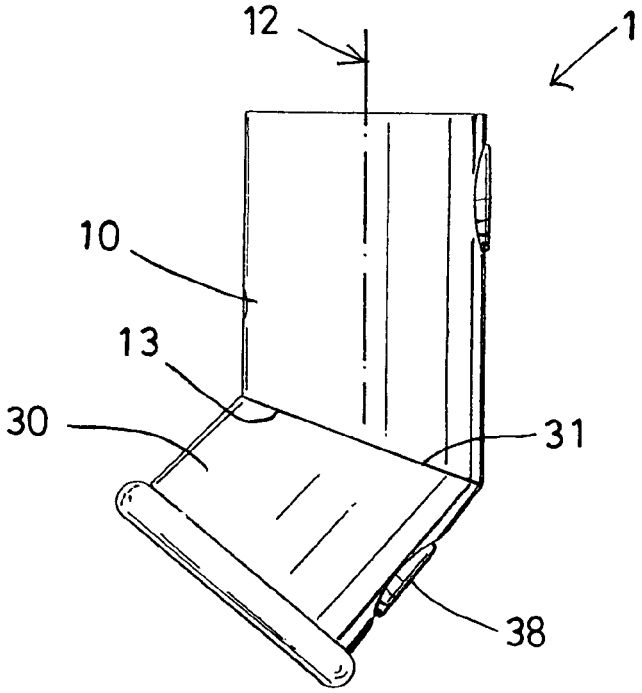
FIG. 6 is a still further side plan schematic view similar to FIG. 2, illustrating the operation of the umbrella handle.

The housing 30 may also include a switch button 38 slidably attached or engaged with the housing 30 and aligned with the switch 58 of the casing 50 or of the flashlight device 5 for allowing the switch 58 of the casing 50 to be depressed or actuated by the switch button 38 of the housing 30, in order to switch or control the light members 56 to selectively generate the light and to suitably light the environment, particularly in the rainy or dark days. In operation, the light generated by the light members 56 may be faced or directed toward various or different directions for suitably lighting the environment when the housing 30 is pivoted or rotated relative to the tubular member 10 to different or various directions (FIGS. 2, 6).

Figure 10:
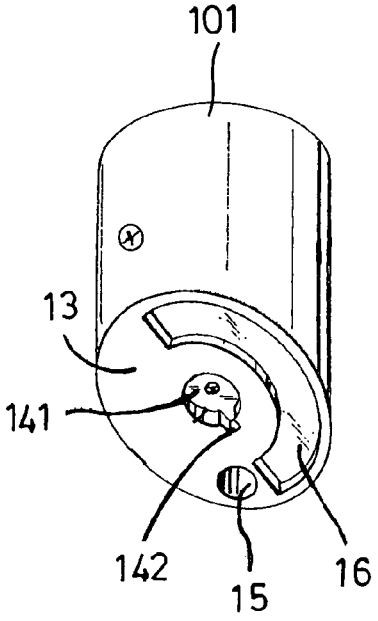
FIG. 10 is a perspective view illustrating a tubular member of the umbrella handle as shown in FIG. 9.
Figure 9:
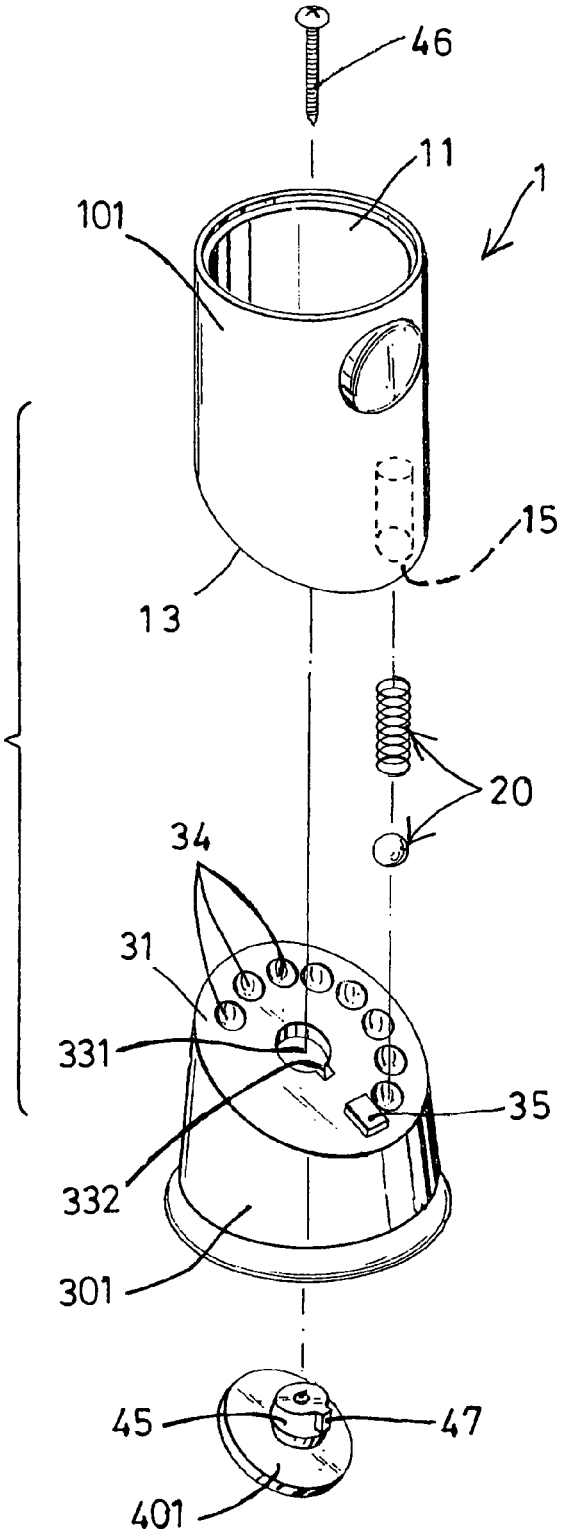
FIG. 9 is another exploded view illustrating the other arrangement of the umbrella handle.
Figure 11:
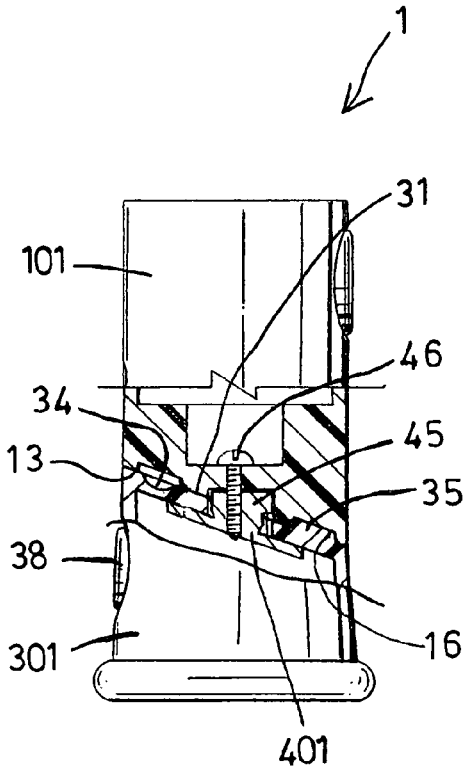
FIG. 11 is a side plan schematic view of the umbrella handle as shown in FIGS. 9 and 10 in which a portion of the umbrella handle has been cut off for showing the inner structure of the umbrella handle.

Alternatively, as shown in FIGS. 9-11, the tubular member 101 may include a recess 141 and a notch 142 formed in the center portion of the bottom wall 13, and not communicative with the chamber 11 of the tubular member 101, and the housing 301 includes an orifice 331 and a notch 332 formed in the center portion of the upper wall 31, and the coupling member 401 includes a shank 45 extended outwardly therefrom and engaged through the orifice 331 of the housing 301 and engaged into the recess 141 of the tubular member 101 and secured to the tubular member 101 with a fastener 46, and includes a key or projection or latch 47 extended from the shank 45 and engaged through the notch 332 of the housing 301 and engaged into the notch 142 of the tubular member 101 for stably and pivotally or rotatably attaching or coupling the housing 301 to the tubular member 101.

Figure 12:
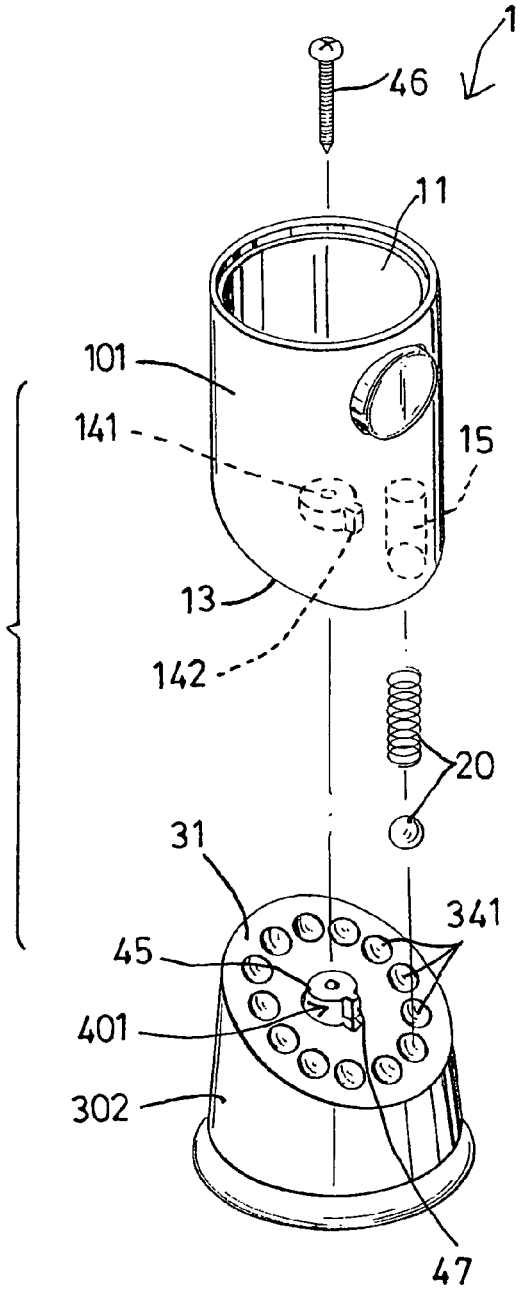
FIG. 12 is a further exploded view illustrating the further arrangement of the umbrella handle.

Further alternatively, as shown in FIG. 12, the housing 302 may include a number of depressions 341 formed in the outer peripheral portion of the upper wall 31 of the housing 302 for selectively engaging with the spring-biased projection 20 and for anchoring or positioning or retaining the housing 302 to the tubular member 101 at the required or predetermined angular directions, and for allowing the housing 302 to be pivoted or rotated relative to the tubular member 101 to different or various directions for about 360 degrees.

Figure 14:
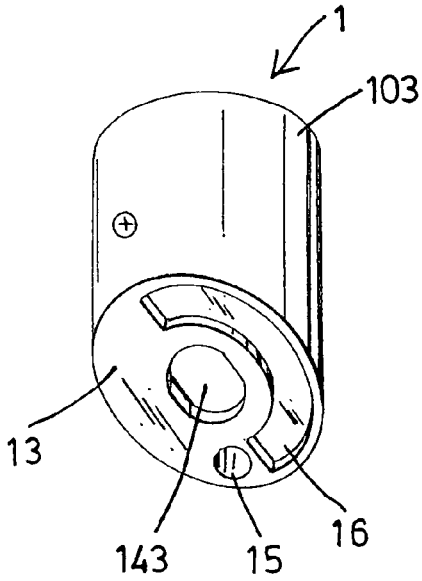
FIG. 14 is a perspective view illustrating a tubular member of the umbrella handle as shown in FIG. 13.
Figure 15:
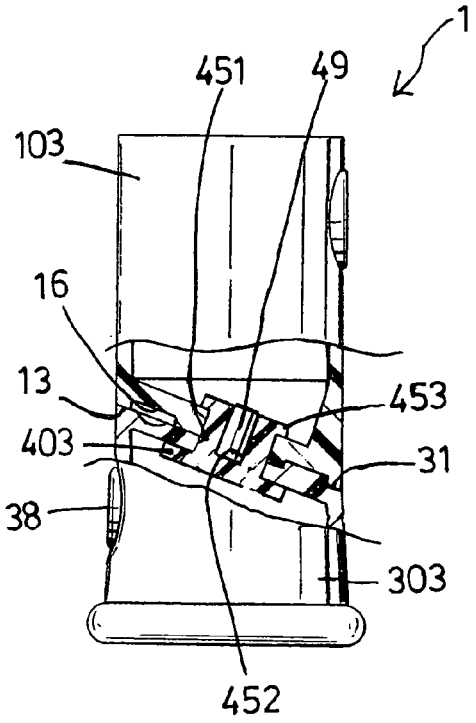
FIG. 15 is a side plan schematic view of the umbrella handle as shown in FIGS. 13 and 14 in which a portion of the umbrella handle has been cut off for showing the inner structure of the umbrella handle.
Figure 13:
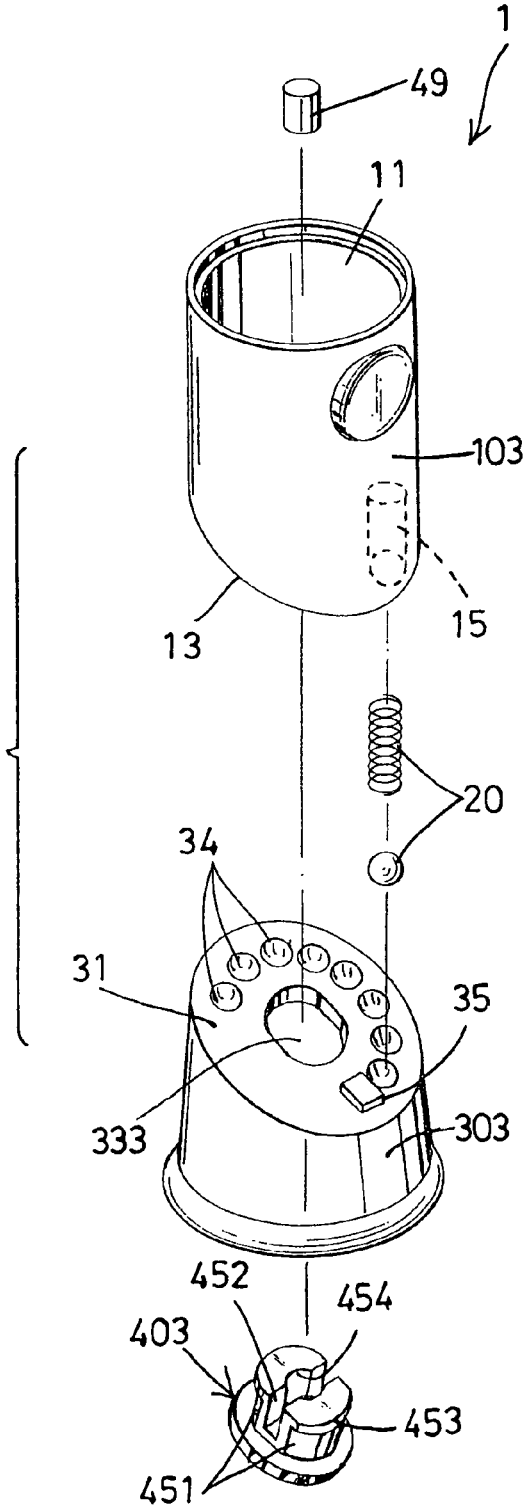
FIG. 13 is a still further exploded view illustrating the still further arrangement of the umbrella handle.

Further alternatively, as shown in FIGS. 13-15, the tubular member 103 may include an oblong hole 143 formed in the center portion of the bottom wall 13, and the housing 303 may also include an oblong hole 333 formed in the center portion of the upper wall 31 of the housing 303 for aligning with the oblong hole 143 of the tubular member 103, and the coupling member 403 includes two spring stems or arms 451 extended outwardly therefrom and engaged through the oblong holes 143, 333 of the tubular member 103 and of the housing 303 for forming or defining a slot 452 between the arms 451, and includes a rib 453 extended from each of the arms 451 for engaging with the tubular member 103 and for solidly securing or mounting the housing 303 to the tubular member 103, and includes an aperture 454 formed in the arms 451 for engaging with a lock pin 49 which may solidly anchor or secure the housing 303 to the tubular member 103.

In operation, as shown in FIGS. 2-4 and 6-8, the housing 30 may be pivoted or rotated relative to the tubular member 10 to different or various directions with the axle 33 and/or the coupling member 40 and for allowing the umbrella handle 1 to be easily and suitably or firmly grasped or held by the user, and the light generated by the light members 56 may be faced or directed toward various or different directions for suitably lighting the environment when the housing 30 is pivoted or rotated relative to the tubular member 10 to different or various directions, and the housing 30 may be anchored or positioned or retained to the tubular member 10 at the required or predetermined angular directions by the engagement of the spring-biased projection 20 with either of the depressions 34 of the housing 30.

Accordingly, the umbrella handle in accordance with the present invention includes a foldable structure for allowing the umbrella handle to be folded to various inclined or tilted configuration and for allowing the umbrella handle to be easily grasped or held by the user, and including a flashlight device attached to the umbrella handle and adjustable to various direction for generating the light toward various direction.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An umbrella handle comprising:

a tubular member including a longitudinal axis, and including an inclined bottom wall tilted relative to said longitudinal axis of said tubular member, and a housing including a longitudinal axis, and including an inclined upper wall tilted relative to said longitudinal axis of said housing, and including an axle for rotatably engaging with said inclined bottom wall of said tubular member and for allowing said housing to be rotated relative to said tubular member to different directions and for allowing said housing to be folded and inclined relative to said tubular member to different folding statuses, said housing including a plurality of depressions formed in said upper wall, and a spring-biased projection engaged into said tubular member and partially extendible out of said tubular member for selectively engaging with either of said depressions of said upper wall and for anchoring said housing to said tubular member at a required angular direction.

2. The umbrella handle as claimed in claim 1, wherein said axle is extended from said inclined upper wall of said housing, and said tubular member includes a coupling member engaged with said axle for coupling said housing to said tubular member.

3. The umbrella handle as claimed in claim 2, wherein said coupling member includes an inner thread formed therein for threading and engaging with said axle.

4. The umbrella handle as claimed in claim 2, wherein said coupling member includes a non-circular engaging hole formed therein.

5. The umbrella handle as claimed in claim 2, wherein said coupling member includes an outer peripheral flange extended radially and outwardly therefrom for engaging with said tubular member and for securing said housing to said tubular member.

6. The umbrella handle as claimed in claim 1, wherein said housing includes a guide extended from said upper wall, and said tubular member includes a curved channel formed in said bottom wall for slidably receiving and engaging with said guide and for limiting said housing to rotate relative to said tubular member.

7. The umbrella handle as claimed in claim 1, wherein said housing includes a flashlight device for generating a light.

8. The umbrella handle as claimed in claim 7, wherein said flashlight device includes at least one battery, a reflector, at least one light member attached to a circuit board and engaged into said reflector and coupled to said at least one battery for generating said light.

9. The umbrella handle as claimed in claim 8, wherein said flashlight device includes a casing engaged into the housing and having a space formed therein for receiving said at least one battery, and a switch slidably attached to the casing for controlling said at least one battery to selectively energize said at least one light member.

10. The umbrella handle as claimed in claim 9, wherein said housing includes a slidable switch button aligned with said switch for being depressed to engage with said switch.

* * * * *